US007849911B2

(12) United States Patent
Weyer et al.

(10) Patent No.: US 7,849,911 B2
(45) Date of Patent: Dec. 14, 2010

(54) METHOD AND DEVICE FOR THE CONTINUOUS CASTING AND DIRECT DEFORMATION OF A METAL STRAND, ESPECIALLY A CAST STEEL STRAND

(75) Inventors: Axel Weyer, Wuppertal (DE); Dirk Letzel, Ratingen (DE); Horst Gärtner, Düsseldorf (DE); Wilfried Milewski, Korschenbroich (DE); Adolf Gustav Zajber, Langenfeld (DE)

(73) Assignee: SMS Siemag Aktiengesellschaft, Dusseldorf (DE)

( * ) Notice: Subject to any disclaimer, the term of this patent is extended or adjusted under 35 U.S.C. 154(b) by 600 days.

(21) Appl. No.: 11/517,997

(22) Filed: Sep. 7, 2006

(65) Prior Publication Data

US 2007/0023161 A1 Feb. 1, 2007

Related U.S. Application Data

(62) Division of application No. 10/498,650, filed on Jun. 10, 2004, now Pat. No. 7,121,323.

(51) Int. Cl.
*B22D 11/12* (2006.01)
*B22D 11/124* (2006.01)

(52) U.S. Cl. ..... 164/417; 164/444

(58) Field of Classification Search ..... 164/417, 164/444, 486, 476, 477
See application file for complete search history.

(56) References Cited

U.S. PATENT DOCUMENTS 3,589,429 A * 6/1971 Schoffmann ..... 164/471
6,536,504 B2 * 3/2003 Takeuchi et al. ..... 164/415
7,121,323 B2 * 10/2006 Weyer et al. ..... 164/476

* cited by examiner

*Primary Examiner*—Kevin P Kerns
(74) *Attorney, Agent, or Firm*—Lucas & Mercanti, LLP; Klaus P. Stoffel

(57) ABSTRACT

A device for continuous casting and direct deformation of a metal strand, with a strand guide which is curved after the continuous casting mold in the direction of strand travel, a spray device for liquid coolant, a bending-straightening unit, and an automatic control system for a uniform temperature field in the strand cross section. The cast strand is cooled with a liquid coolant only in the longitudinal sections in which the cast strand is liquid in the cross section. The curved strand guide with the spray device for liquid coolant is followed by a dry zone, which operates without liquid coolant and serves as insulation against the elimination of radiant heat and systematically surrounds the cast strand. A reduction line is provided, which includes individual, hydraulically adjustable deforming rolls or several hydraulically adjustable roll segments and precedes, coincides with, or follows the region of the bending-straightening unit.

5 Claims, 8 Drawing Sheets

A - A normal position drive position with insulation

METHOD AND DEVICE FOR THE CONTINUOUS CASTING AND DIRECT DEFORMATION OF A METAL STRAND, ESPECIALLY A CAST STEEL STRAND

The present application is a division of U.S. patent application Ser. No. 10/498,650, filed Jun. 10, 2004, and issued as U.S. Pat. No. 7,121,323.

BACKGROUND OF THE INVENTION

The invention concerns a method and a device for the continuous casting and direct deformation of a metal strand, especially a cast steel strand, which has a rectangular format or the format of a bloom, preliminary section, billet, or round, is guided in a curved strand guide after the continuous casting mold, subjected to secondary cooling with a liquid coolant, and prepared in an automatically controlled way for the deformation pass at a uniform temperature field in the strand cross section.

In general, in the continuous casting of different steel grades and dimensions or formats, one's attention is directed at the strand shell growth during secondary cooling and at the position of the tip of the liquid crater in a deformation line. It is known, for example, from EP 0 804 981 that the cast strand can be sufficiently compressed in the deformation line to produce the desired final thickness. However, this makes it necessary to determine the position of the tip of the liquid crater, based upon which the deformation force is applied horizontally along a wedge-shaped surface. However, a process of this type is relatively coarse and does not take into account the state of the microstructure that is to be expected. The reason lies in the unsatisfactory heat distribution due to unfavorable cooling and uniform strand support with nonuniform heat dissipation from the strand cross section. Adjustment of the secondary cooling to the strand support does not occur, either. To improve these conditions, it was proposed in German Patent Application 100 51 959.8, which has not been pre-published, that the secondary cooling be analogously adapted in its geometric configuration to the solidification profile of the cast strand on the following traveling length of the cast strand. The strand support is likewise analogously reduced as a function of the solidification profile of the cast strand at the respective travel length. In this connection, with increasing travel length, the corner regions of the cast strand cross section are less cooled than the middle regions. In the realization of this process, the spray angles of the spray jets in the secondary cooling are adjusted to the strand shell thickness in such a way that a low spray angle is assigned to a decreasing liquid crater width. A significant equalization of the temperature in the strand cross section over layers of the strand cross section is already achieved by these measures.

With this knowledge, the inventor of the above-cited, unpre-published patent application further recognized that the manner in which the process of so-called soft reduction of the cast strand is carried out must be further optimized. This recognition is based on the fact that high deformation resistance due to unfavorable temperature distribution in the cast billet or in the cast preliminary section with variable ductility causes variable deformation resistance and variable strain and thus leads to cracking.

An improvement of the internal quality of cast strands with different cross-sectional shapes and dimensions, especially with respect to positive segregation, core porosity, and core breakdown, requires a reduction process in the solidification range. The previously used procedure, e.g., with billet cross sections, leads to circular solidification with circular isotherms in the cross section, which develop in the region of the bending and straightening driver. Since only a reduction in the core is possible with this type of temperature distribution, only a mechanically influenced final solidification is achieved. However, the results are unsatisfactory and subject to very strong fluctuations. The reason is that the region of final solidification is very difficult to determine.

SUMMARY OF THE INVENTION

The objective of the invention is to produce the necessary temperature distribution in the cast strand and thus to optimize the deformation pass and to obtain a useful microstructure of the final solidification at the end of the deformation pass.

In accordance with the invention, this objective is achieved by cooling the cast strand with a liquid coolant only in the longitudinal sections in which the cast strand is predominantly liquid in the cross section, by equalizing the temperature of the cast strand in a transition zone before, in, and/or after a bending-straightening unit by insulation of the exterior surface that is radiating heat, basically without the use of a liquid coolant, and further equalizing the temperature by heat radiation in zones, and by deforming the cast strand on a dynamically variable reduction line on the basis of the compressive strength measured by individual deforming rolls or roll segments, depending on the compressive force that can be locally applied. The advantages are a casting and cooling process that better prepares the deformation process with a varied solidification or temperature profile in the strand cross section and a reduction process with a continuous or variable course of reduction, which lead to a largely defect-free microstructure of the final solidification.

The deformation process can be further optimized if the temperature field consists of elliptical, horizontally oriented isotherms.

In addition, an advantageous refined condition is created if the temperature pattern is uniformly formed in the transverse and longitudinal direction of the core region in the strand cross section.

A procedure of this type is further assisted by compressing the cast strand on the dynamically variable reduction line in the core region in the transverse and longitudinal direction.

The edge lengths of a polygonal strand cross section play an important role in the cooling of the cast strand. Therefore, it is quite important for the deformation to be carried out as a function of the strand format, the strand dimensions, and/or the casting speed.

Basically, the deformation on the deformation line can be carried out by two systems, namely, deformation by point pressing by individual deforming rolls or by approximate surface pressing by roll segments.

Another embodiment of the method in the case of surface pressing consists, in the case of deformation by roll segments, in the use of different conicities for different steel grades in the adjustment of the roll segments.

Another very important aspect of the invention is the automatic control and regulation, i.e., the measuring and automatic control engineering of the deformation operation. To this end, the method described above provides automatic control by adjusting several roll segments in the normal position or with constant conicity or with progressive conicity or with variable conicity, which can be adjusted by the automatic control system. The deformation can then be carried out accordingly, depending on the deformation resistance that is determined.

In addition, the continuous or variable course of reduction is assisted by automatically controlling the compression of the core region of the cast strand by determining its deformation resistance and/or the distance traveled by the strand.

A less mechanically influenced final solidification is then achieved by compressing approximately horizontal layers in the strand cross section, which have the same isotherms, during the deformation.

A shape-preserving supportive measure that can be used here consists in supporting and guiding the cast strand, at least during the deformation, by support rolls that lie against the two lateral faces.

In this regard, the total deformation energy supplied can be distributed by adjusting the rate of the reduction process to 0-14 mm/m.

The process of the general type described above for continuous casting and direct deformation is designed in such a way with respect to the automatic control engineering that the instantaneous deformation rate is adjusted to the given temperature of the cast strand and/or to the casting rate by continuously measuring the deformation resistance on the individual deforming rolls or on the individual roll segments, determining the position of the tip of the liquid crater on the basis of the given contact force, and automatically controlling the volume of coolant, the contact force, the casting rate, and/or the run-out rate of the deformed cast strand.

Fixed initial values can be additionally obtained by initially assigning a deformation rate to each deforming roll or each roll segment in a fixed relationship.

The device of the general type described above for continuous casting with direct deformation is designed in such a way that the curved strand guide with the spray device for liquid coolant is followed by a predominantly dry zone, which operates for the most part without liquid coolant and serves as insulation against the elimination of radiant heat and systematically surrounds the cast strand, and that a reduction line is provided, which consists of individual, hydraulically adjustable deforming rolls or several hydraulically adjustable roll segments and precedes, coincides with, or follows the region of the bending-straightening unit.

In the event of a shift of the tip of the solidification cone, a correction can be made by displacing roll segments that are arranged in the direction of strand travel next to one or more stationary bending-straightening units either in the direction of strand travel or in the opposite direction.

Different deformation forces can be applied within the roll segments if each reduction roll segment has at least two pairs of rolls, of which at least one adjustable deforming roll is equipped with a piston-cylinder unit.

In the case of a rigidly installed lower pair of deforming rolls or a rigid lower roll segment, the different deforming forces can also be produced by equipping the upper, adjustable deforming roll or the upper, adjustable roll segment each with two piston-cylinder units per pair of rolls, such that the piston-cylinder units are arranged in succession on the centerline or are arranged in pairs outside the centerline.

In another measure for an advantageous deformation line, the roll spacing in a roll segment is selected as a close spacing in the range of 150-450 mm.

It is further proposed that bending-straightening units installed in the region of the radiation insulation are likewise insulated from heat radiation by the cast strand.

Embodiments of the method and device of the invention with the deformation line are illustrated in the drawings and explained in greater detail below.

DETAILED DESCRIPTION OF THE INVENTION

Figure 1:
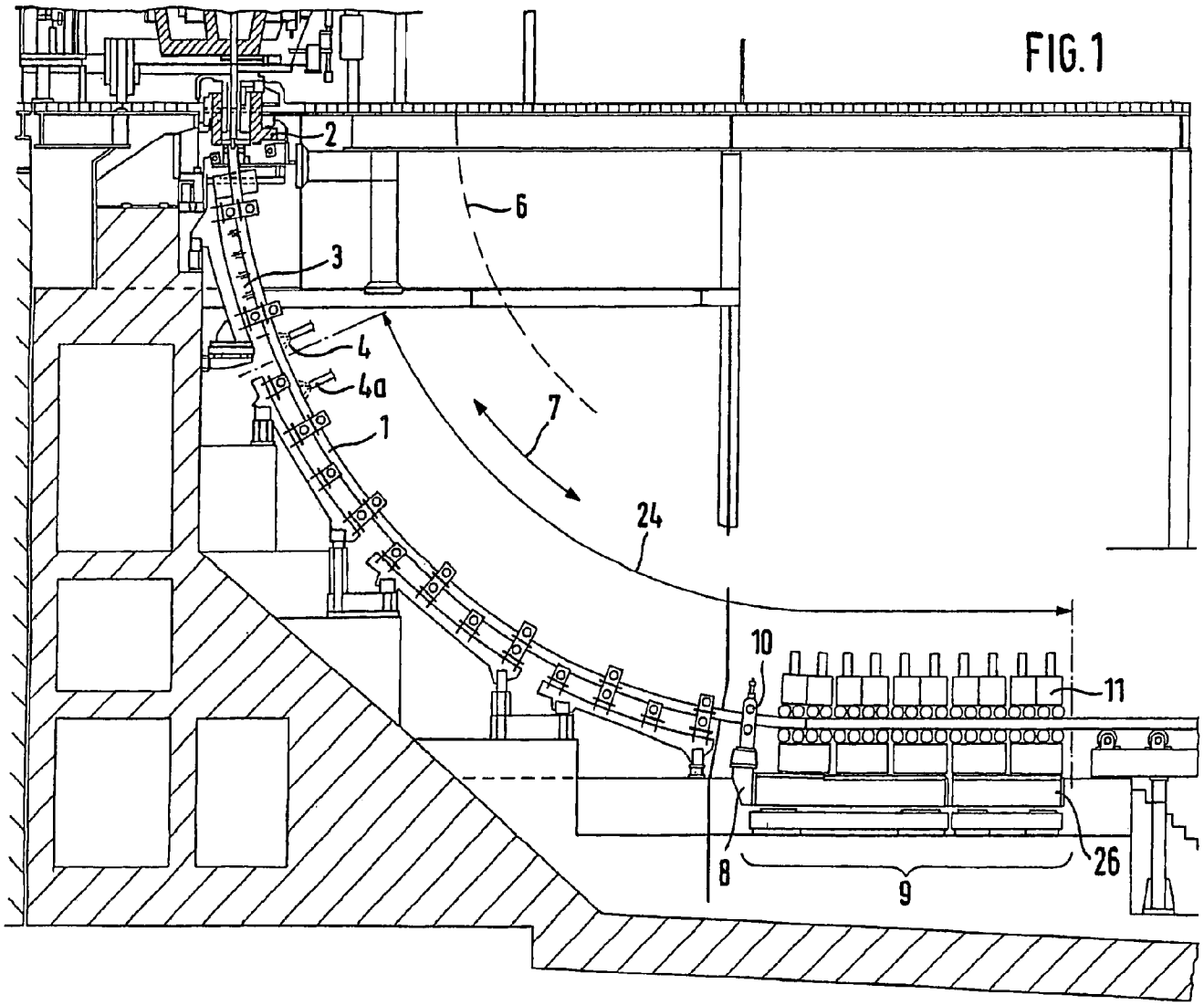
FIG. 1 shows a side view of a continuous casting device, e.g., for billet formats.

FIG. 1 shows a continuous casting device for the example of a billet strand format 1*d* of a cast strand 1. However, the strand cross section 1*a* could also have a rectangular format or the format of a bloom, preliminary section, or round.

Figure 2:
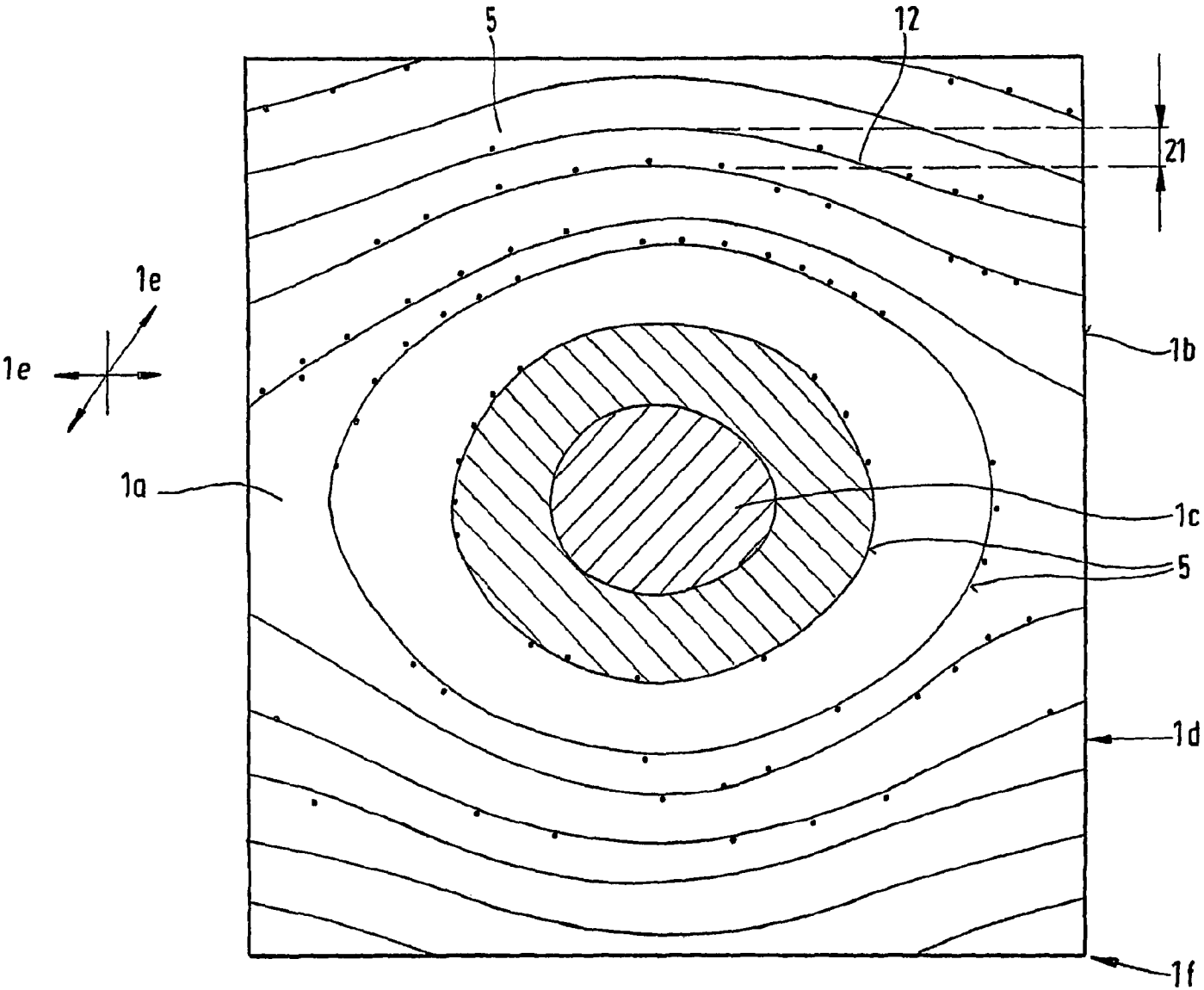
FIG. 2 shows an effective strain lying in the plane with an elliptical temperature field in stationary operation.

The molten steel material from a continuous casting mold 2 is subjected to secondary cooling with liquid coolant 4, e.g., water, in a (curved) strand guide 3 and adjusted to a uniform temperature field 5 in the strand cross section 1*a* by an automatic control system (cf. FIG. 2 also). This results in a liquid-cooled longitudinal section 6 with a solid shell and a liquid core region 1*c*.

Figure 11:
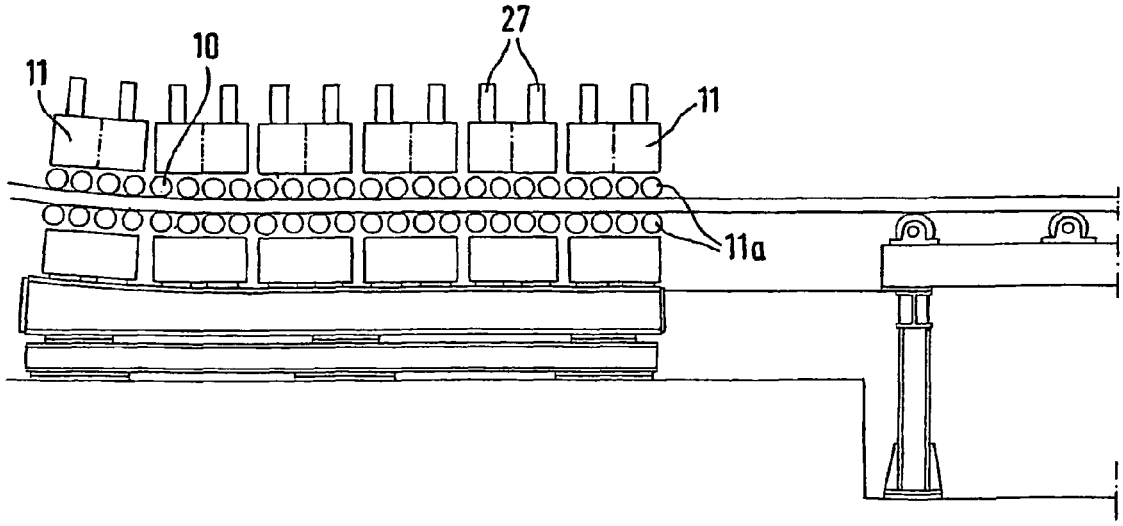
FIG. 11 shows an alternative embodiment of the deformation line with individual driven deforming rolls.

The curved strand guide 3 with a spray device 4*a* for the liquid coolant 4 is followed by a predominantly dry zone 24, which operates for the most part without liquid coolant 4 and serves as insulation 25 against the elimination of radiant heat and systematically surrounds the cast strand 1, such that the possible length of insulation in the longitudinal region indicated by arrows is maintained as a function of the strand format 1*d*, the dimensions, the casting speed, and other parameters of this kind. The dry zone 24 can, for example, as shown in the drawing, extend over the liquid/dry transition zone 7 as far as the bending-straightening unit 8 with a preceding or following reduction line 9. The reduction line 9 consists of individual, hydraulically adjustable deforming rolls 10 or of several hydraulically adjustable roll segments 11, as shown in FIG. 11.

Figure 3:
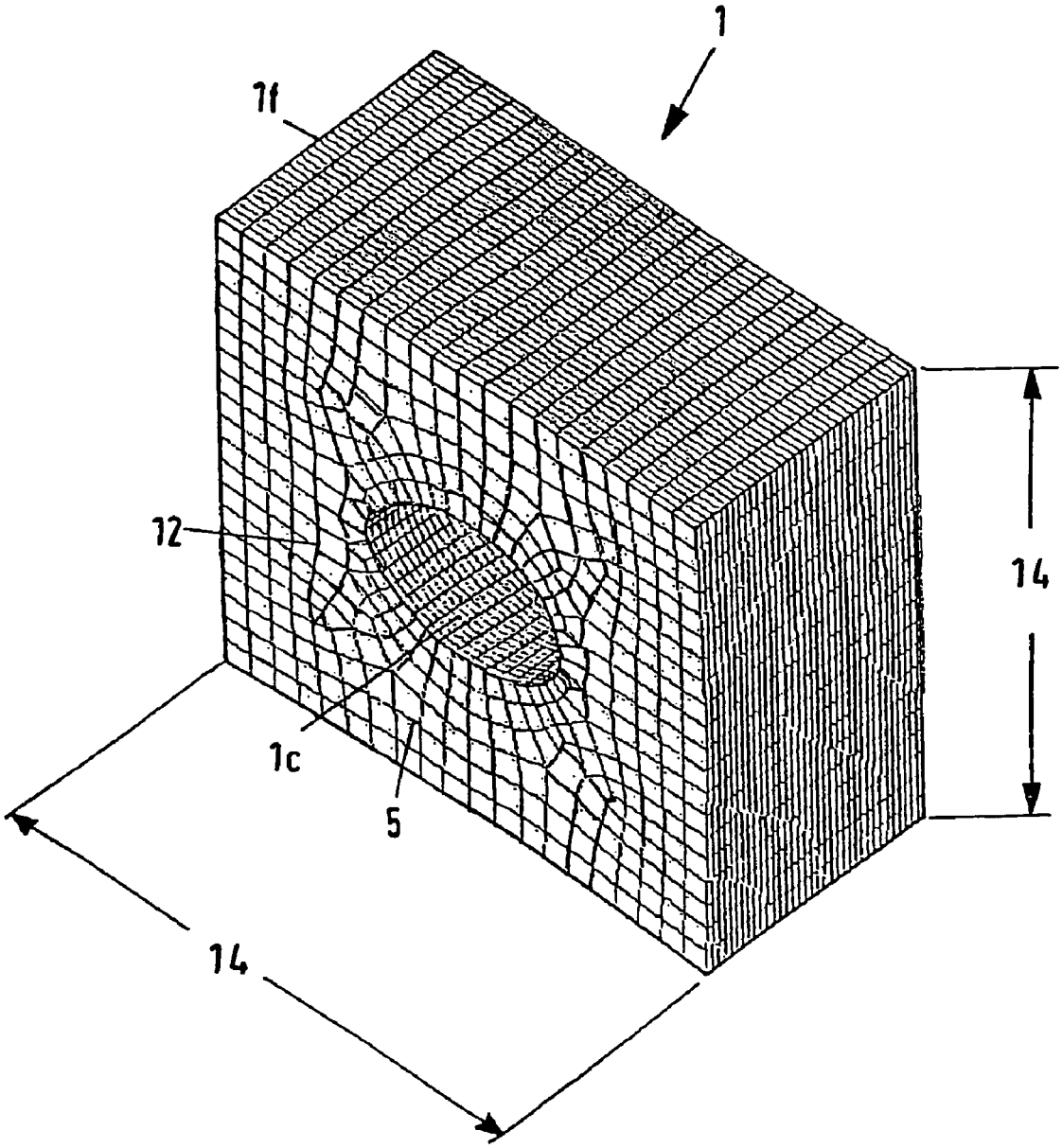
FIG. 3 shows a perspective view of a cutaway portion of effective strain with an elliptical temperature field after the first pass in the deformation line.

The method based on the continuous casting machine for molten steel explained above is now carried out in such a way (FIGS. 2 and 3) that the cast strand 1 is used by the liquid coolant 4 only in liquid-cooled longitudinal sections 6 in which the cast strand is still liquid or predominantly liquid in the cross section 1*a*. In a transition zone 7 before, in, and/or after the bending-straightening unit 8, the heat-radiating exterior surface 1*b* is thermally insulated basically without the use of the liquid coolant, so that heat radiation in such zones results in less cooling and/or support of colder cross-sectional parts, e.g., the corner edges if, than of other cross-sectional parts that are connected with the still hot or liquid core region 1*c*. This equalizes the heat distribution in the strand cross section 1*a*. The temperature field 5 is obtained with elliptical, essentially horizontally oriented isotherms 12 (FIGS. 2 and 3).

The cast strand 1 is deformed on the basis of this improved temperature distribution on a dynamically variable reduction line 9 and on the basis of the compressive strength measured by the individual deforming rolls 10 or one or more roll segments 11, depending on the compressive force that can be applied locally.

The temperature field 5 (FIG. 2) is formed uniformly in the transverse and longitudinal direction 1*e* of the core region 1*c* in the strand cross section 1*a*.

Figure 4:
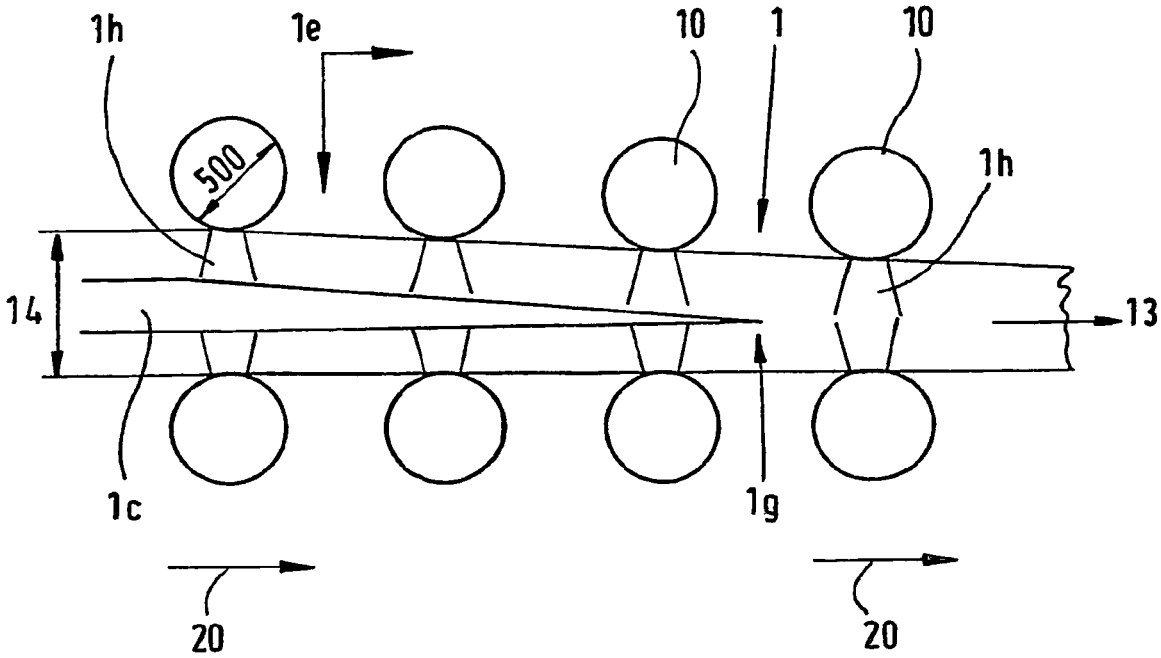
FIG. 4 shows a first system of soft reduction with individual deforming rolls.
Figure 5:
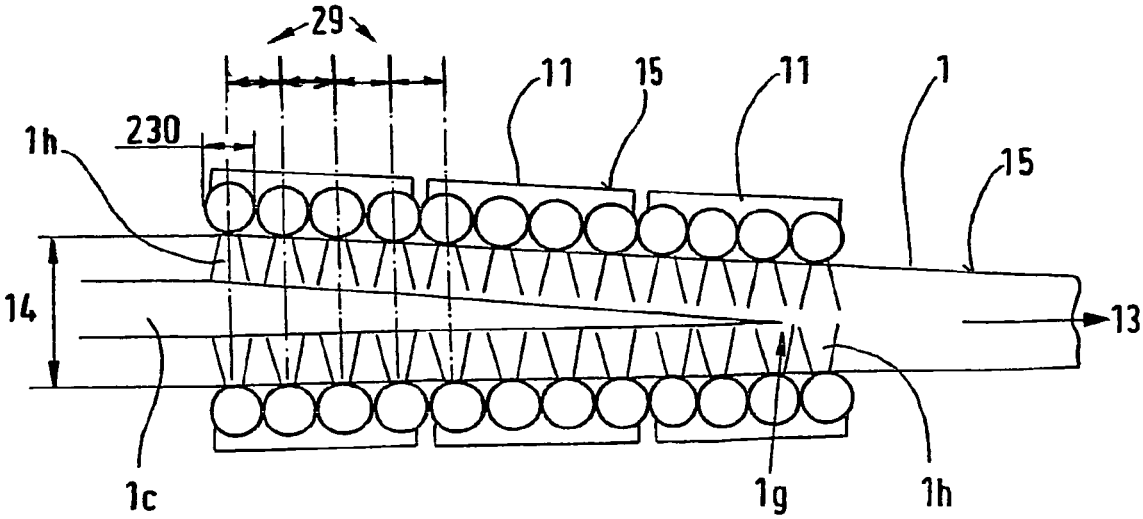
FIG. 5 shows a second system of the deformation line with roll segments.

On the basis of the isotherms 12, the cast strand 1 can be compressed on the dynamically variable reduction line 9 in the core region 1*c* in the transverse and longitudinal direction 1*e* (FIGS. 4 and 5). The deformation is carried out as a function of the strand format 1*d*, the strand dimensions 14, and/or the given casting speed in the longitudinal direction 13. The deformation can also be carried out by line pressing (FIG. 4) by individual deforming rolls 10, or by approximate surface pressing by several roll segments 11 (FIG. 5). In this connection, the core region 1*c* is compressed to a liquid crater tip 1*g* in each case. In the case of deformation by roll segments 11, different conicities 15 can be used for different grades of steel by suitable adjustment of the roll segments 11.

Figure 6:
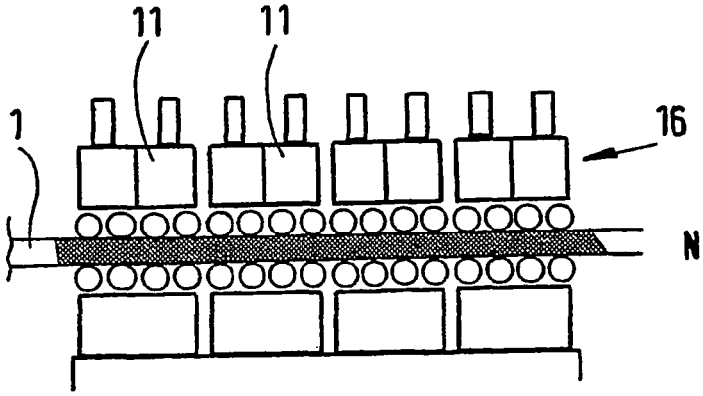
FIGS. 6 to 9 show different conicity settings of the roll segments.
Figure 7:
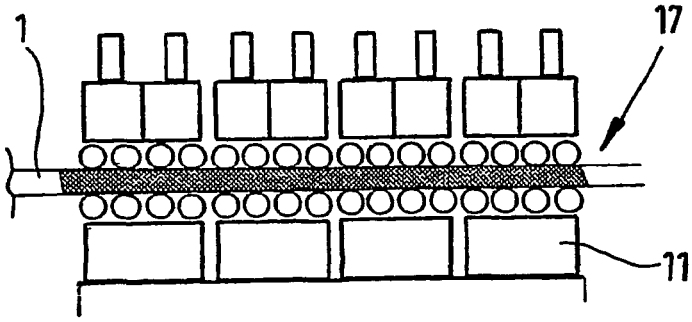
Figure 8:
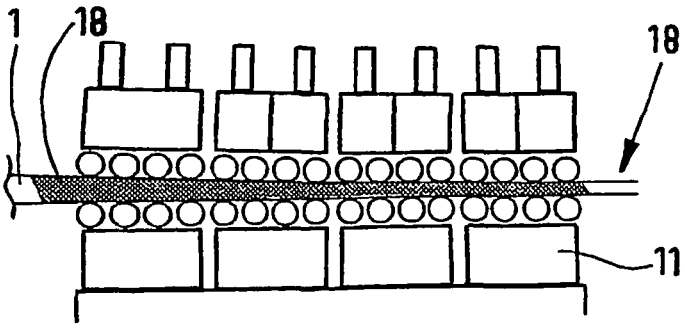
Figure 9:
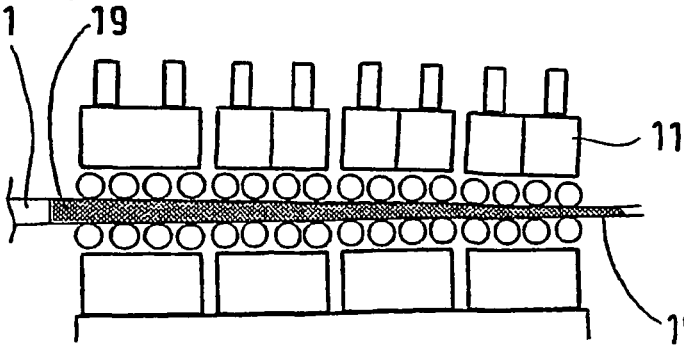

Examples of different conicities 15 are shown in FIGS. 6 to 9. FIG. 6 shows the "normal position" 16 of the roll segments 11, i.e., the conicity is 0°. Nevertheless, compression occurs. In FIG. 7, a constant conicity 17 is set for all roll segments 11. On the other hand, FIG. 8 shows a changing angle of conicity from one roll segment 11 to the next in the sense of progressive conicity 18. It is also possible, as shown in FIG. 9, to set a variable conicity 19, depending on the position of the tip of the liquid crater 1*g*.

The compression of the core region 1*c* (FIGS. 4 and 5) of the cast strand 1 by the pressure cones 1*h* is initially controlled by determining the given deformation resistance and/or a strand distance 20 that has been traveled (distance determination). The formation of the temperature field 5 uniformly in the transverse and longitudinal direction 1*e* of the core region 1*c* is especially effective here. So-called optimized isotherms 12 are obtained in this way. The isotherms 12 run especially flat in this case. The deformation resistance can be measured, for example, under an individual deforming roll 10 by measurement of the hydraulic pressure in a hydraulic line or other hydraulic component.

Layers 21, which, advantageously, are approximately horizontal and have the same isotherms 12, are compressed in the transverse direction 1*e* of the strand cross section 1*a* (cf. FIGS. 2 and 3). During the compression of the core porosities, existing segregations can be eliminated at the same time. The given layer 21 that is still hotter and thus softer yields during this compression process.

Figure 12B:
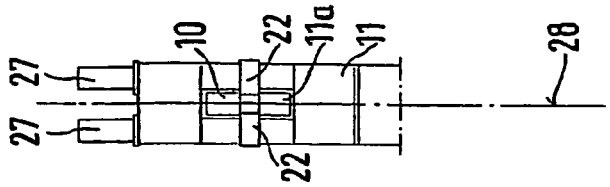
FIGS. 12A and 12B show side views of another alternative embodiment of the bending-straightening units and the roll segments.

As FIG. 12B shows, it is advantageous to install support rolls 22 that rest on the two exterior surfaces 1*b* during the deformation to prevent spreading of the cast strand 1 on its exterior surface 1*b*. The rate of the reduction process can be adjusted and automatically controlled to (instantaneously) 0-14 mm per running meter of cast strand 1.

Furthermore, the automatic control process for a soft reduction takes place: The instantaneous deformation rate is adjusted to the given temperature of the cast strand 1 and/or the (set) casting speed (e.g., 3.2 m/min). To this end, the deformation resistance is continuously measured (e.g., by the hydraulic pressure) on the individual deforming rolls 10 or on the individual roll segments 11. The position of the tip 1*g* of the liquid crater is determined on the basis of the given contact force that is determined, and, for example, the volume of the sprayed coolant 4, the contact force, the casting speed, and/or the run-out rate of the deformed cast strand 1 is automatically controlled, so that the tip 1*g* of the liquid crater reaches a desired position within the thus dynamic, variable reduction line 9. A deformation rate can be initially assigned to each individual deforming roll 10 or each roll segment 11 in a fixed relationship according to the conicity system of FIGS. 6 to 9.

The essential assemblies of the deformation line 10 are shown in FIGS. 10 to 13C.

Figure 10:
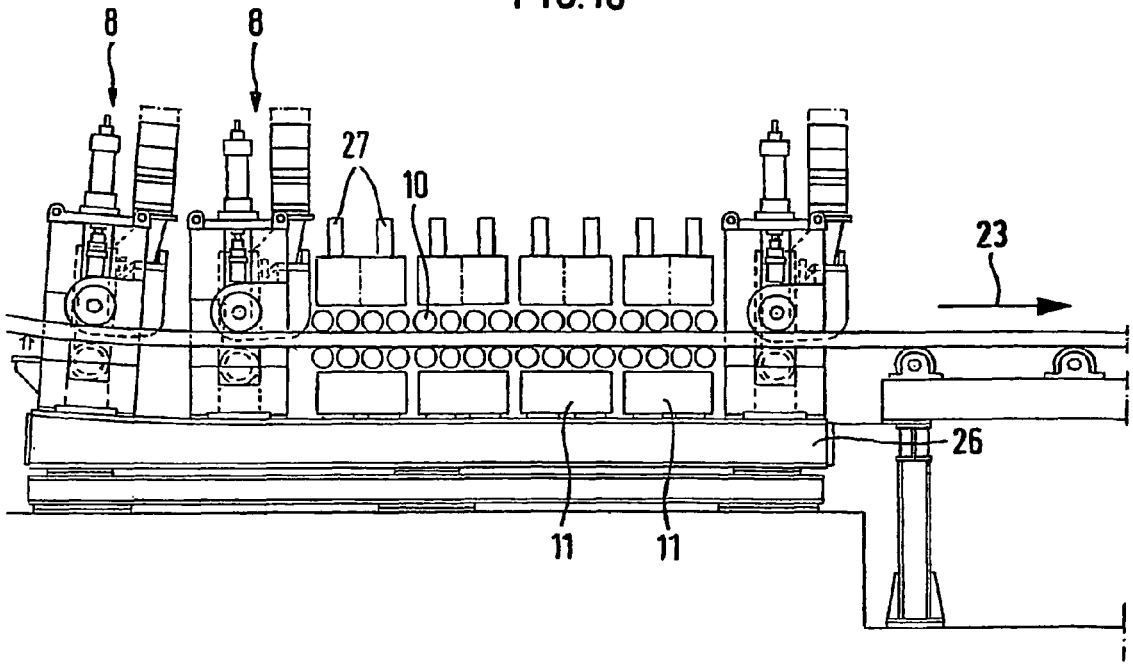
FIG. 10 shows a side view with several bending-straightening units and with the deformation line.

In FIG. 10, several roll segments 11 are located next to one or more stationary bending-straightening units 8 on a common base plate 26. The base plate 26 with the bending-straightening units 8 and the (four) roll segments 11 shown in the drawing can be displaced back and forth to a limited extent in the region of a varied position of the tip 1*g* of the liquid crater and accordingly is connected to the automatic control system.

Each of the (six) reduction roll segments 11 is equipped with at least two pairs of rolls 11*a*. At least one adjustable deforming roll 10 is equipped with a piston-cylinder unit 27.

Figure 12A:
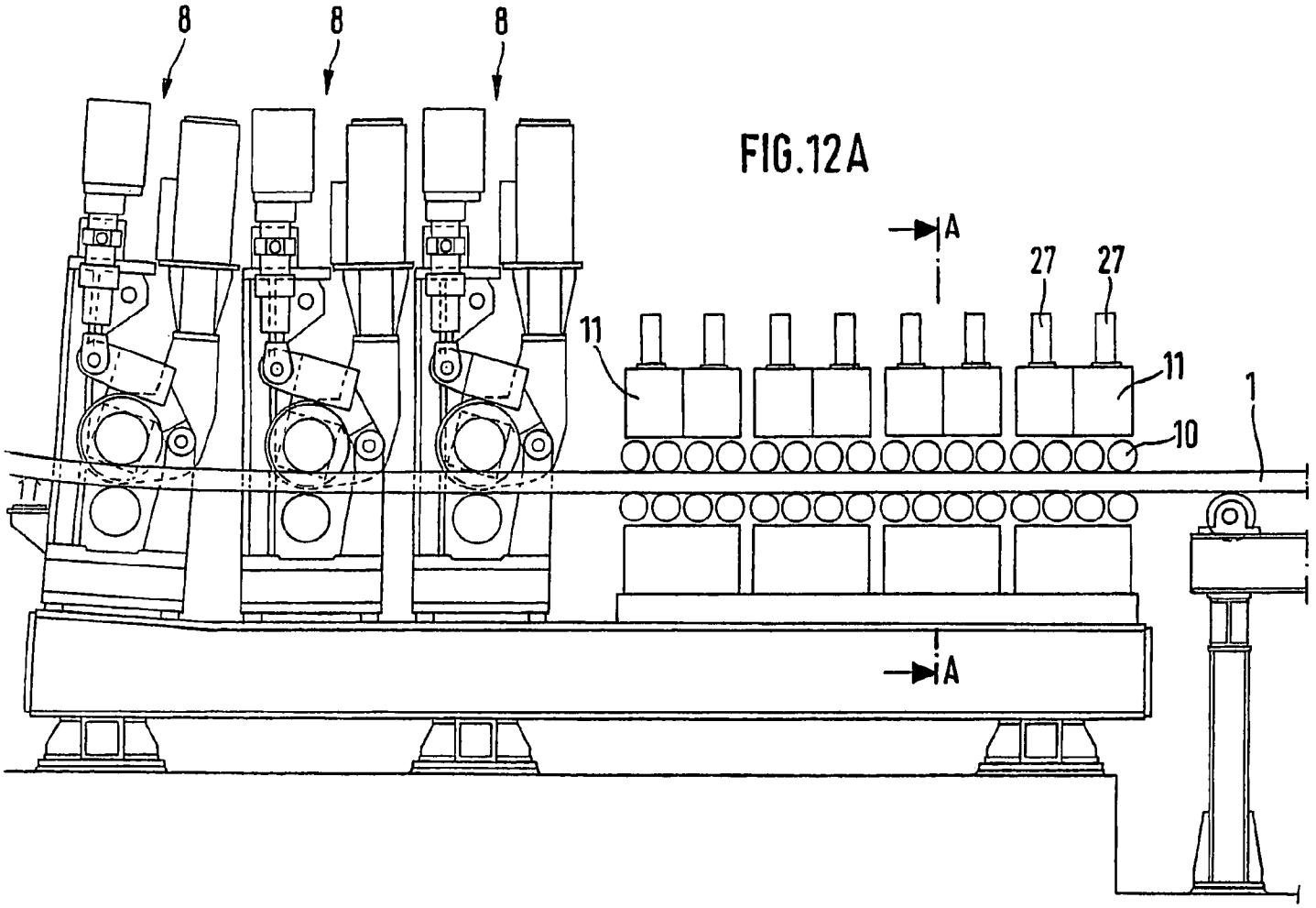

As FIGS. 12A and 12B show, in the case of a rigid lower pair 11*a* of deforming rolls or a rigid lower roll segment 11, the upper, adjustable deforming roll 10 or the upper, adjustable roll segment 11 can each be provided with two piston-cylinder units 27 arranged in succession on the centerline 28 or arranged in pairs outside the centerline 28.

The roll spacing 29 (FIGS. 4 and 5) on a roll segment 11 is selected as a close spacing in the range of 200-450 mm at a roll diameter of 230 mm (roll segment 11) or 500 mm (individual deforming roll 10).

Figure 13A:
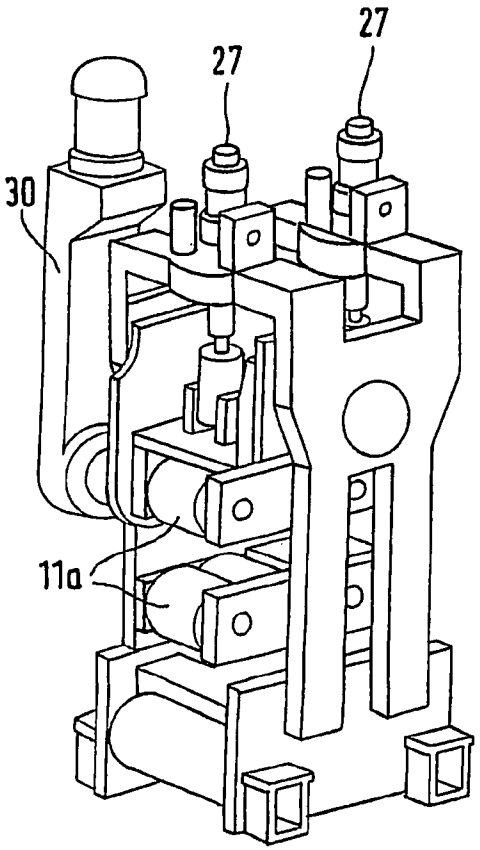
FIG. 13A shows a deformation stand in normal position.
Figure 13B:
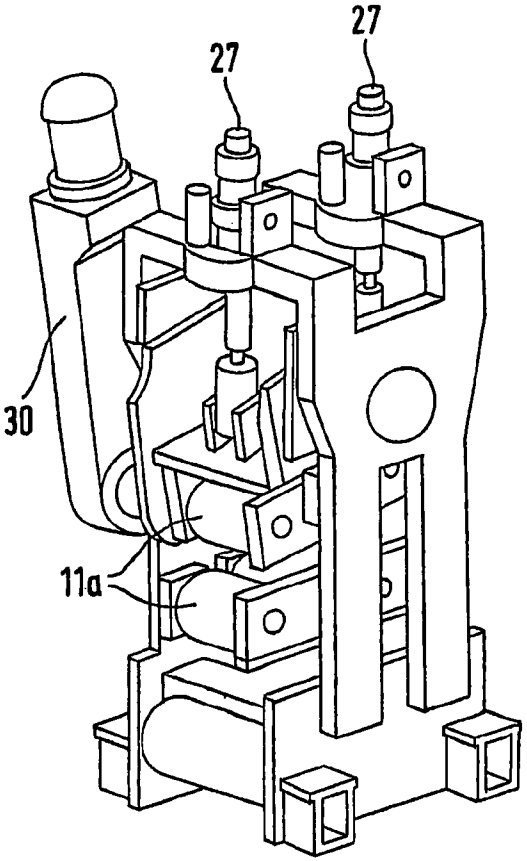
FIG. 13B shows a deformation stand in drive position.
Figure 13C:
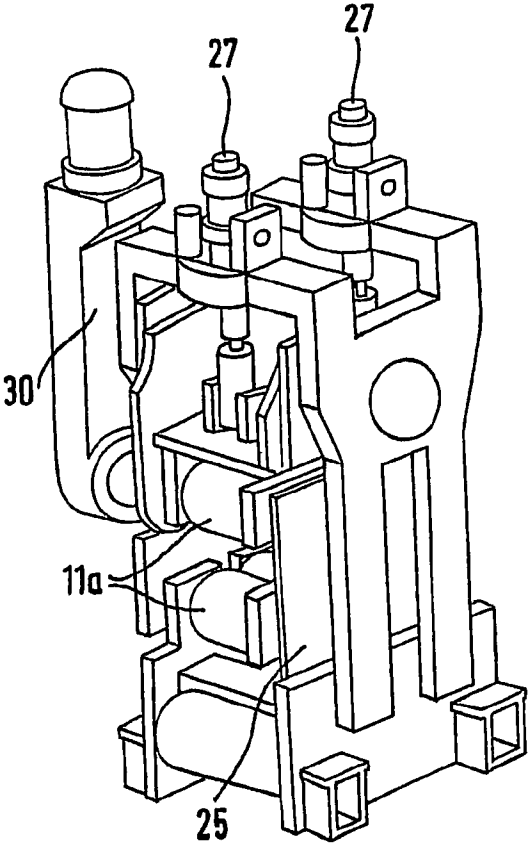
FIG. 13C shows the deformation stand with insulation.

FIGS. 13A, 13B, and 13C show an individual roll segment 11 of this type for a billet format. In FIG. 13A, the drive 30 and the pair of rolls 11*a* are in the normal position. In FIG. 13B, the pair of rolls 11*a* and the drive are shown in the drive position. FIG. 13C shows the insulation 25 in the area the reduction line 9.

The invention can also be used to advantage for the entire spectrum of steel grades, such as special steels, high-grade steels and stainless steels.

LIST OF REFERENCE NUMBERS

1 cast strand
1*a* strand cross section
1*b* exterior surface
1*c* core region
1*d* strand format
1*e* transverse and/or longitudinal direction
1*f* corner edges
1*g* tip of the liquid crater
1*h* pressure cone
2 continuous casting mold
3 (curved) strand guide
4 liquid coolant
4*a* spray device
5 temperature field, temperature pattern
6 liquid-cooled longitudinal section
7 transition zone
8 bending-straightening unit
9 dynamically variable reduction line
10 deforming roll
11 roll segment
11*a* a pair of rolls
12 isotherm
13 longitudinal direction
14 strand dimension

15 different conicities
16 normal position
17 constant conicity
18 progressive conicity
19 variable conicity
20 strand travel distance
21 horizontal layer of equal temperature
22 support rolls
23 direction of strand travel
24 dry zone
25 insulation
26 base plate
27 piston-cylinder unit
28 centerline
29 roll spacing
30 drive FIG. 6. KEY:
Normal-Position=normal position
konstante Konizität=constant conicity
progressive Konizität=progressive conicity
variable Konizität=variable conicity FIG. 13. KEY:
Normalstellung=normal position
Antriebstellung=drive position
mit Isolierung=with insulation

The invention claimed is:

1. Device for continuous casting and direct deformation of a metal strand, which has a rectangular format or a format of a bloom, preliminary section, billet, or round, with a strand guide (3) which is curved after continuous casting mold (2) in the direction of strand travel (23), a spray device (4*a*) for liquid coolant (4), a bending-straightening unit (8), and an automatic control system for a uniform temperature field (5) in a thickness cross section (1*a*) of the strand, such that the cast strand (1) is cooled with a liquid coolant (4) only in the longitudinal sections (6) in which the cast strand (1) is liquid in the cross section (1*a*), wherein the curved strand guide (3) with the spray device (4*a*) for liquid coolant (4) is followed by a dry zone (24), which operates without liquid coolant (4) and serves as insulation (25) against the elimination of radiant heat and systematically surrounds the cast strand (1), and that a reduction line (9) is provided, which consists of several hydraulically adjustable roll segments (11) and precedes, coincides with, or follows the region of the bending-straightening unit (8), wherein a detection apparatus is provided for determining the position of the tip of a liquid crater, wherein roll segments (11) of the reduction line are displaceably arranged on a common base plate (26) in the direction of strand travel (23) next to one or more stationary bending-straightening units (8) and are displaceable in the direction of strand travel (23) or in the opposite direction, wherein the control system displaces the base plate with the roll segments back and forth according to the determined position of the tip of the liquid crater.

2. Device in accordance with claim 1, wherein each reduction roll segment (11) has at least two pairs of rolls (11*a*), of which at least one adjustable deforming roll (10) is equipped with a piston-cylinder unit (27).

3. Device in accordance with claim 1, wherein, in the case of a rigidly installed lower pair (11*a*) of deforming rolls or a rigid lower roll segment (11), the upper, adjustable deforming roll (10) or the upper, adjustable roll segment (11) are each equipped with two piston-cylinder units (27) per pair of rolls (11*a*), such that the piston-cylinder units are arranged in succession on the centerline (28) or are arranged in pairs outside the centerline (28).

4. Device in accordance with claim 1, wherein the roll spacing (29) in a roll segment (11) selected as a close spacing in the range of 150-450 mm.

5. Device in accordance with claim 1, wherein bending-straightening units (8) installed in the region of the radiation insulation (25) are likewise insulated from heat radiation by the cast strand (1).

* * * * *